United States Patent [19]

Thornhill

[11] 4,318,416

[45] Mar. 9, 1982

[54] LIGHTER WITH INTEGRAL PIPE TAMPER

[76] Inventor: John R. Thornhill, 6521 Stone Bridge Rd., Santa Rosa, Calif. 95405

[21] Appl. No.: 95,584

[22] Filed: Apr. 24, 1980

[51] Int. Cl.[3] ..... A24F 9/02

[52] U.S. Cl. ..... 131/243; 131/247; 431/253

[58] Field of Search ..... 131/184, 243, 247; D27/36, 38; 431/253, 2

[56] References Cited

U.S. PATENT DOCUMENTS 2,633,137 3/1953 Narrogon ..... 131/243
2,719,526 10/1955 Bachman ..... 131/247
3,178,016 4/1965 Coats ..... 431/253 X
3,220,420 11/1965 Genoud ..... 431/253 X

*Primary Examiner*—Stephen C. Pellegrino
*Attorney, Agent, or Firm*—Alvin E. Hendricson

[57] ABSTRACT

A lighter for pipes and the like has a case thereof formed with a deep indentation extending upwardly from the bottom in spaced relation to one vertical side to form an integral pipe tamper structure and an insert containing wadding or the like for absorbing lighter fluid has a lower cut out portion encompassing the tamper structure and case indentation for slidable disposition in the case.

1 Claim, 5 Drawing Figures

LIGHTER WITH INTEGRAL PIPE TAMPER

BACKGROUND OF INVENTION

It is well known by pipe smokers that tobacco requires tamping after being lighted in order to improve burning thereof in a desired manner. While this tamping may be accomplished with the thumb, the burning tobacco is both hot and the coals are black so that a separate tamping element is preferrably employed. Such a separate element may or may not always be readily available to a pipe smoker and thus there have been developed and marketed a variety of ingenious arrangements for connecting pipe tampers to pipe or cigarette lighters. Such arrangements include hinged tampers, sliding tampers and in fact most conceivable manners of mounting a tamper on a lighter. Examples of this art are to be found in U.S. Pat. Nos. 1,063,066, 2,633,137, 2,719,526, 3,220,420, 3,269,396, 3,263,690 and 3,746,013.

The necessary complication of the above-noted arrangements add to the necessary cost thereof and limit their longevity. The present invention provides a combination of lighter and tamper which is integral in structure to thus obviate the problems of prior art devices.

SUMMARY OF INVENTION

The present invention provides a lighter case having a deep indentation in the bottom thereof to define a tamping leg at one side of the case which is dimensioned to readily fit into a pipe bowl so that the under surface thereof may be employed to tamp tobacco in a pipe bowl.

The lighter of the present invention may have substantially the same overall configuration as popular cigarette lighters in having somewhat of a rectangular or boxlike shape with means for striking a flint to ignite a wick at an upper end thereof. The invention is adaptable to different types of lighters and for those having a removable interior shell containing wadding or the like such shell is formed with a lower cut out at one side thereof encompassing the indentation and tamper leg volume of the lighter case.

DESCRIPTION OF FIGURES

The present invention is illustrated as to a single preferred embodiment in the accompanying drawings, wherein.

DESCRIPTION OF PREFERRED EMBODIMENT

Figure 1:
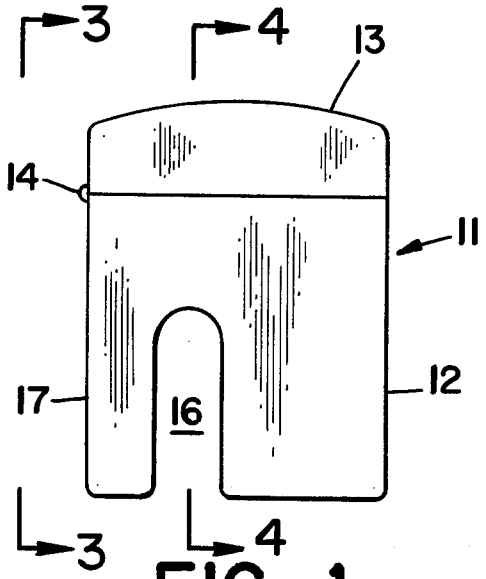
FIG. 1 is a side elevational view of a combination lighter and tamper in accordance with the present invention.
Figure 3:
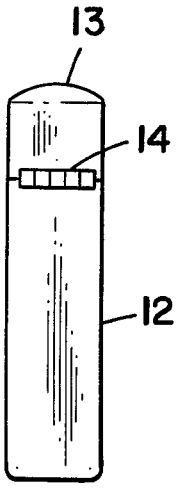
FIG. 3 is an end elevational view taken in the plane 3—3 of FIG. 1.
Figure 4:
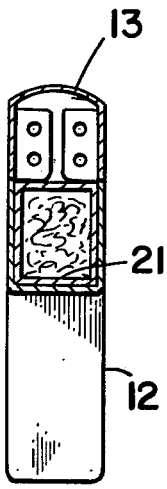
FIG. 4 is a vertical sectional view taken in the plane 4—4 of FIG. 1.
Figure 2:
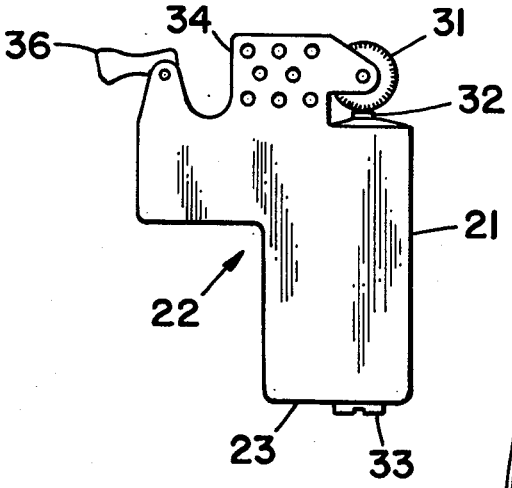
FIG. 2 is a side elevational view of an internal shell and operating elements of the lighter of FIG. 1.

The present invention is illustrated as to a single preferred embodiment thereof in the drawings and referring to FIGS. 1 through 4 there will be seen to be provided a lighter 11 having a case 12 with an openable top 13 hinged at 14 to the lower portion of the case. The lighter case 12 has a generally rectangular configuration with a thickness of the order of $\frac{1}{4}$ to $\frac{1}{2}$ an inch and in accordance with the dimensioning of conventional cigarette lighters the case may have a total height of 2 to 4 inches and may have a width of about 1 to $1\frac{1}{2}$ inches.

The present invention provides for the case 12 to have a deep indentation 16 in the bottom thereof with the interior of the case being sealed thereabout. This indentation 16 has a width in excess of the width of the upright wall of a smoking pipe bowl and has a depth or vertical height of about an inch or so. The indentation 16 is laterally spaced from the vertical wall of the case a distance less than the internal diameter of a pipe bowl and in practice this spacing may be of the order of $\frac{1}{4}$ of an inch. The bottom of the case 12 is substantially flat and the indentation 16 will be seen to define a vertically depending portion of the case between the cavity 16 and the adjacent case wall, which is herein termed a temper leg 17. This tamper leg will thus be seen to have a width that may be of the order of $\frac{1}{4}$ of an inch or so and a vertical length of the order of one inch. This portion of the lighter case is adapted to be employed as a pipe tamper inasmuch as the indentation 16 is wide enough to fit over the side of a pipe bowl so that the tamper leg 17 may be moved downwardly into the open top of a pipe bowl, as further discussed below.

The present invention is adapted to accommodate any desired type of lighter mechanism and medium. Thus, for example, the invention is adapted for use with lighters employing lighter fluid and lighters employing butane or the like. In the illustrated example of the present invention there is shown a lighter having a hinged top as previously described and adapted to include an inner shell 21 that is normally packed with wadding of cotton or the like for absorbing lighter fluid to retain such fluid within the lighter. In this embodiment of the present invention the inner shell 21 is dimensioned to be slidably disposed within the case 12 through the openable top 13. The inner shell 21 will be seen in FIG. 2 of the drawings to be provided with a cut-out 22 in the lower corner thereof. If the hinged portion of the case be considered the back thereof then the shell 21 is provided with the cut-out on the lower rear corner.

The vertical height of the cut-out 22 is made at least as great as the vertical depth of the indentation 16 in the lighter case 12 and the width of the cut-out 22 is made at least as great as the combined width of the tamper leg 17 and indentation 16 in the lighter case. Consequently, the inner shell 21 will slide into the case 12 with the cut-out in the shell encompassing the lower left hand portion of the case as illustrated in FIG. 1.

In this embodiment of the present invention the inner shell 21 is preferably formed with an open bottom 23 through which lighter fluid may be provided for absorption by the internal filler or wadding in the shell and the remainder of the shell is formed of a thin metal sheet, for example, including the side and top of the cut-out 22 in order to retain the material within the shell.

Conventional striking and igniting means may be provided at the top of the internal shell 21 including a rotatable striking wheel 31 engaging a flint 32 that is urged against the wheel by an internal spring (not shown) by a screw 33 threaded into the bottom of a tube mounted vertically in the shell. A short appertured flu 34 surrounds a wick (not shown) which extends downwardly into the wadding or the like within the shell 21. Spring loaded latching means 36 may also be provided for normally maintaining the top of the case 13 in closed position. The striking and burning elements of the lighter are only illustrated and described herein as an example, for many types of mechanisms of this sort are known in the art and may be employed in the present invention.

The combined lighter and pipe tamper of the present invention will be seen to be particularly adapted for physical configuration in conformity with at least many conventional cigarette lighters. In particular it is noted that the exterior configuration of the present invention comprises a relatively flat rectangular object which is readily carried in the pocket so as to be at all times available to the pipe smoker for lighting of the pipe and tamping of tobacco in the bowl thereof.

Figure 5:
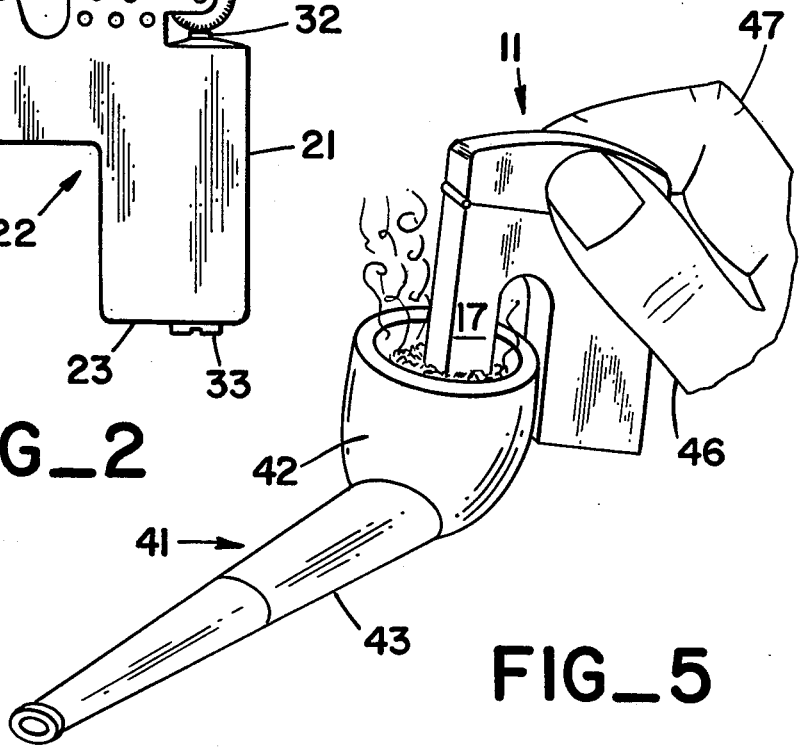
FIG. 5 is a perspective view of the combination lighter and tamper of FIG. 1 in use as a pipe tamper.

While it may be relatively simple to press unlighted pipe tobacco into a bowl pipe, it is normally required that the tobacco be further compressed or tamped after it has been lit. In this respect, reference is made to FIG. 5 illustrating a smoking pipe 41 having a bowl 42 extending upwardly from the forward end of a pipe stem 43. The combined lighter and pipe tamper of the present invention may be readily employed to ignite tobacco in the bowl 42 of the pipe 41 merely by flipping the top 13 of the lighter open and striking a flame with the lighter so that holding the flame over the top of the bowl and inhaling through the pipe stem will draw the flame downwardly into contact with the tobacco for igniting same.

After tobacco in the pipe bowl is ignited, the present invention, as illustrated at 11 in FIG. 5, may be readily employed as a pipe tamper by gripping the case 12 between the thumb 46 and forefinger 47 and pressing the tamper leg 17 downwardly onto the open top of the pipe bowl 42. The indentation 16 in the bottom of the lighter case 12 allows the tamper leg 17 to be inserted into the pipe bowl, for the lighter fits over the side of the pipe bowl which may extend upwardly into the depression 16, again as illustrated in FIG. 5.

It will be seen that the present invention provides a very simple combination of lighter and pipe tamper which ensures the presence of one with the other so as to provide maximum convenience for the user. Additionally, the integral nature of the lighter and pipe tamper hereof precludes prior art problems of mechanical complexity and moving parts which eventually wear out. If desired, it is also possible to reinforce the bottom wall of the tamper leg 17 although the normal construction of a lighter case of stainless steel, for example, is adequate to prevent damage to the bottom of the tamper leg 17 during use. It is additionally noted that the tamper leg 17 is not filled with material that absorbs lighter fluid and thus the lighter fluid is at all times maintained at a substantial distance from the heat of tobacco burning in the bowl of a pipe, even though the present invention is employed as a pipe tamper.

The present invention has been described above with respect to a single preferred embodiment thereof which will be seen to have widespread utility and marked simplicity which commends the invention to use by pipe smokers. The invention is, of course, also suited to the lighting of other than pipe tobacco such as cigarettes, candles or anything else that the user may desire to light, for the relatively small size and convenient shape of the present invention provides for same to be readily carried by those desiring to carry a lighter.

Although the present invention has been described and illustrated with respect to a single preferred embodiment thereof, it will be apparent to those skilled in the art that numerous modifications and variations may be made within the spirit and scope of the present invention and thus it is not intended to limit the invention by the precise terms of description or details of illustration.

What is claimed is:

1. A combination lighter and integral pipe tamper comprising a lighter case having an openable top portion for exposing a flame to light tobacco in a pipe or the like, said case having a deep indentation in the bottom thereof in spaced relation to a first side of said case and defining between said indentation and said first side of said case an integral fixed tamper leg adapted to be inserted in a pipe bowl for tamping tobacco therein, and an integral shell adapted for slidable engagement within said case through said openable top portion with absorbant material therein for retaining lighter fluid therein and said shell having a cut-out lower corner portion with a height substantially equal to the depth of said case indentation and a width substantially equal to the width of said case cavity and said tamper leg.

* * * * *